US006908360B1

(12) United States Patent
Christensen

(10) Patent No.: US 6,908,360 B1
(45) Date of Patent: Jun. 21, 2005

(54) BOOMERANG-LIKE TOY

(76) Inventor: Steven L. Christensen, 5124 Lowell, Overland Park, KS (US) 66202

( * ) Notice: Subject to any disclaimer, the term of this patent is extended or adjusted under 35 U.S.C. 154(b) by 0 days.

(21) Appl. No.: 10/847,793

(22) Filed: May 18, 2004

(51) Int. Cl.[7] ..... A63H 27/00

(52) U.S. Cl. ..... 446/46; 446/48; 446/66; 446/236; 473/490; D12/333

(58) Field of Search ..... 446/46, 48, 61, 446/66, 34, 68, 236; 473/590, 588, 589; 244/36, 39, 154; D12/333; D21/441, 443, 444, 449, 451, 301

(56) References Cited

U.S. PATENT DOCUMENTS

| | | | | | |
|---|---|---|---|---|---|
| 4,388,777 | A | * | 6/1983 | Hermann et al. | 446/61 |
| D314,366 | S | * | 2/1991 | Waaland et al. | D12/333 |
| D382,851 | S | * | 8/1997 | Knutson et al. | D12/333 |
| D418,840 | S | * | 1/2000 | Cota et al. | D14/230 |
| 6,138,957 | A | * | 10/2000 | Nastasi et al. | 244/219 |
| 6,306,004 | B1 | * | 10/2001 | Farrar | 446/61 |

* cited by examiner

*Primary Examiner*—Bena B. Miller
(74) *Attorney, Agent, or Firm*—David E Herron, II

(57) ABSTRACT

The invention is a projectile plaything, namely a boomerang-like toy that, if properly thrown, will fly in an arcuate path and return to the area of its release. The plaything will be formed to imitate the shape of the United States Air Force B2 Bomber, aka the Stealth Bomber.

15 Claims, 3 Drawing Sheets

BOOMERANG-LIKE TOY

FIELD OF THE INVENTION

The invention is a boomerang-like airfoil toy bearing specific appearance and attributes of the Stealth or B-2 Bomber, making the toy more attractive than a standard boomerang toy. Hence the name hereinafter used, bomberang.

BACKGROUND OF THE INVENTION

The toy has several distinctive features and attributes, including but not limited to:

a. its operation as a boomerang, i.e., when properly thrown the toy will return to the general area from which it was thrown, due to the shape of the airfoil from which it is constructed;

b. The physical appearance of the device is similar to an existing military aircraft within the arsenal of the United States Air Force. Specifically, the outline of the toy is similar to the B2 bomber, or the Stealth Bomber [hereinafter, B2].

The bomberang is constructed as a single, unitary airfoil having the basic outline shape as a modified isosceles triangle. The angle subtended by the equal-length sides of the isosceles triangle serves as the front or "nose" of the device. Preferably, this angle is formed to be approximately 90–100 degrees. The equal length sides of the isosceles triangle are generally straight. In appearance, these equal length sides form the wing-like airfoils, and in appearance serve as the leading edges of the wings of the B2. The construction of the device is such that the unit itself does not appear to include a combination of wings and separate fuselage, but the entire device approximates a lifting body and appears similar to a delta wing type structure. The aforementioned wings project slightly beyond the third side of the device's triangular shape, and are squared off at their respective termination points, to more closely resemble the wing shape of the B2, yet still serving as the airfoils for the device.

The third side of the generally triangular shaped device connects to the previously noted wings, forming nominal 40–45 degree angles with the leading edges of the wings. This third side is cut on its trailing surface in a sawtooth pattern and forms, in appearance, the edge of the lifting body. This sawtooth pattern consists of three teeth, and is intended to generally resemble the appearance of the trailing edge of the lifting body that forms the B2 of the United States Air Force. This is, as noted, the trailing edge in appearance only since individual edges along the sawtooth pattern include both leading and trailing edges of the boomerang itself.

An opening is cut from the central portion of the device, specifically, the central portion of the delta wing/triangular shape of the unit. This cutout allows the airfoil, as required, to maintain the operation of the unit as a boomerang, while still retaining in general, the shape of the B2. The shape of the removed portion follows in generally the edges of the nominally triangular shape of the entire device, allowing the maintained width of the remaining material in the device to act as an airfoil. When constructed of heavier materials, the failure to remove the cutout portion results in the width of the body of the device being too heavy to function as an airfoil type device. The removal of this central portion of the original triangular shape allows device to approximate the airfoil nature and similar function to that of a standard boomerang, while maintaining leading and trailing edges and adequate structure that retains the appearance of the B2.

The main body of the toy is formed from a single thin piece of material, initially the shape of an isosceles right triangle. Indeed, the legs of the isosceles form an angle that is preferably 90–100 degrees, and the vertex of this angle formed by the legs will comprise the front or "nose" of the device and therefore mimics the nose of the B2. The wings continue rearward from the nose, and are squared off at their respective termination points, and form a line generally parallel to the leading edge of the opposite wing. The rear of the invention at the outside edges is formed by the two wings, each of which form a trailing edge of the wing on either side of the device.

The appearance of the device is such that the trailing edge of each of the wings is constructed nominally parallel to the leading edge of the respective opposite wing. Additionally, each wing then extends toward the front of the device, approximately one-third (⅓) of the distance from the front to the back of the respective wing. The jagged sawtooth pattern is preferably made up of three regular serrations centered between the trailing edges of the opposite wings.

SUMMARY OF THE INVENTION

The invention is a projectile plaything that preferably returns to the general location from which it is thrown, similar in function to that of a standard boomerang. The plaything includes a top face and an opposite facing bottom face. A nose point is formed at respective initial points of a first edge and a second edge, which bear generally equal lengths.

The third edge of the plaything has a generally jagged sawtooth pattern and connects terminal points of the first and second edges. More particularly, the sawtooth pattern includes first short edge that extends from the terminal point of the first edge in a direction generally parallel to the second edge. A first parallel edge extends from the first short edge and runs generally parallel to the first edge.

The third edge, namely the jagged-sawtooth edge, also includes a second short edge extending from a terminal point of the second edge. This second short edge extends in a direction generally parallel to the first edge. A second parallel edge extends from the second short edge and running generally parallel to the second edge.

Each of the first and second parallel edges cooperate to form a wing-like protrusion from the body of the toy, similar in appearance to the main wings of the B2 and useful in this device as a handle for throwing/launching the device.

In order to create the proper aerodynamics when the plaything is rotationally thrown, the respective first and second parallel edges are each tapered.

The sawtooth pattern of the third edge also bears a plurality of V-Shaped projections, preferably three V-Shaped projections, which more accurately mirrors the shape and design of the B2. Each V-Shape has a vertex that points away from the nose point.

The first edge of the plaything bears a leading chamfer formed along the first edge and angling from the top face toward the bottom face. This leading chamfer starts at a point between ends of the first edge. The leading chamfer linearly broadens from the stating point of the leading chamfer.

The second edge of the plaything bears a trailing taper that is formed along the second edge and starts from the nose point and linearly broadening distal the nose point.

The plaything also bears a cut-out portion between the nose point and the sawtooth pattern. Preferably, edges of the cut-out portion bears a chamfer generally forming a continuation of the taper on the second edge.

The trailing taper formed on the second edge may actually start from the nose point, broaden linearly along the entire length of the second edge, and terminate adjacent the second short edge. In contrast, the leading chamfer may start at a point on the first edge that is generally equidistant the length of the first parallel edge.

The sawtooth pattern may have a first, a middle, and a third V-Shaped projection, such that the outline of the plaything is generally symmetric about a line passing through the nose and a vertex of the middle V-Shaped projection. In order to create the proper airfoil effect, the first, and third V-Shaped projections may each bear a leading edge that is generally parallel to the second edge of the plaything and a trailing edge that is generally parallel to the first edge of the plaything; and, the trailing edge of each of the first and third V-Shaped projection bears a taper.

DETAILED DESCRIPTION OF THE PREFERRED EMBODIMENTS

Figure 1:
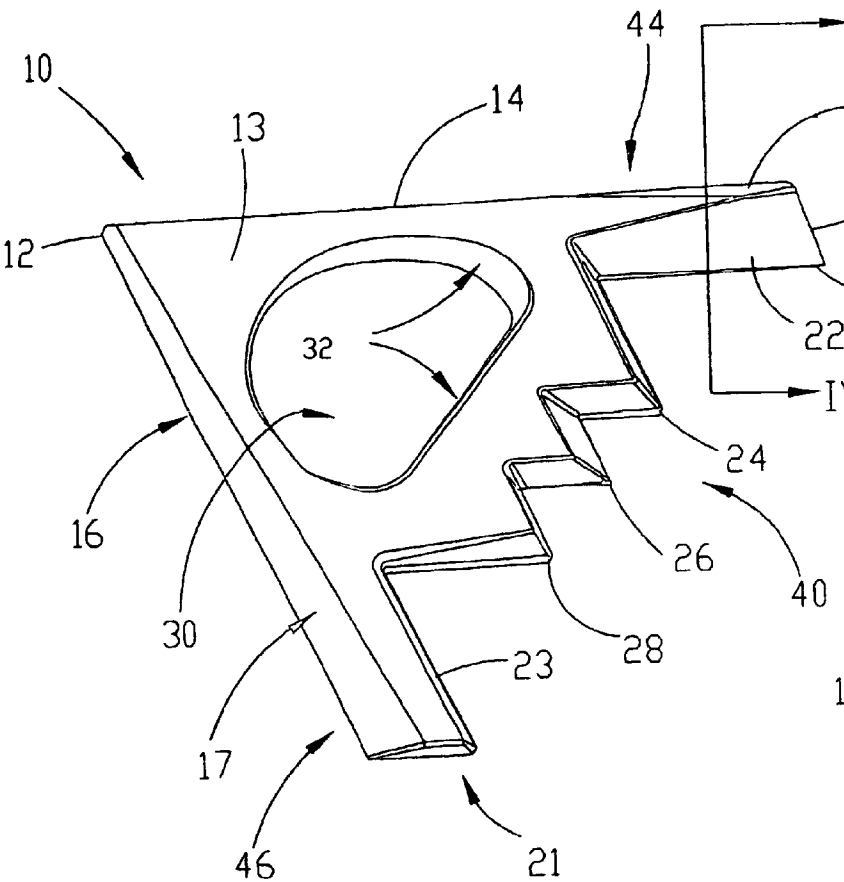
FIG. 1 is a perpective view of the projectile plaything, according to the principles of the invention.

FIG. 1 shows a perspective view, as seen from above and behind, of the projectile plaything (hereinafter, bomberang). The Bomberang has a first edge 14 and a second edge 16 that come together at nose 12 to form a nominal right angle. Indeed, the preferred angle for the nose 12 is between 90 and 100 degrees. The first edge 14 bears a leading chamfer 18 that originates at a point intermediate the nose and the first short edge 20. Indeed, it is preferred that the leading chamfer 18 begin at a point about ⅔ of the way from the nose 12 to the terminus of the first edge 14. This chamfer on the leading edge is constructed with a radius and terminated on the bottom side of the device.

As seen in FIG. 1, the first short edge 20 extends from the terminus of the first edge 14; the first short edge 20 extends generally parallel to the second edge 16. A first parallel edge 19 extends from the first short edge 20 and runs generally parallel to the first edge 14.

Still referring to FIG. 1, the first edge 14 and second edge 16 generally form the legs of an isosceles right triangle having nose 12 as the right angle. The third edge 40 of the right-angle triangle bears a general sawtooth-like pattern having V-shaped projections 24, 26 and 28 that point in a direction opposite the nose 12.

As further seen in FIG. 1, a cut-out portion 30 is positioned between the nose 12 and the third edge 40. Edges of the cut-out portion 30 bear a tapered edge 32, which assists in creating the airfoil effect when the bomberang 10 is thrown so that it rotates about an axis generally perpendicular to the bomberang 10.

Figure 2:
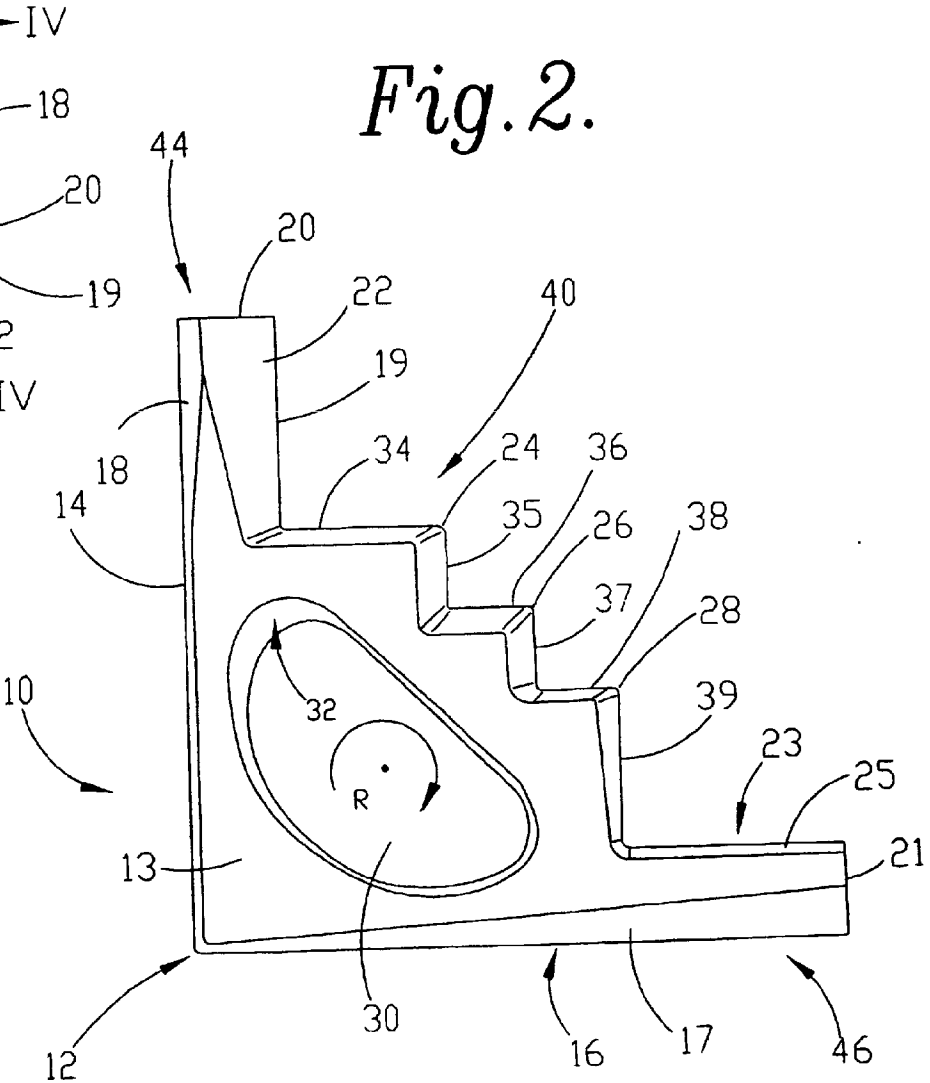
FIG. 2 is a plan view, from above, of the projectile plaything.

FIG. 2 shows an overhead view of the top face 13 of the bomberang 10. The first edge 14 bears a leading chamfer 13. As shown, the leading chamfer 18 extends from an initial point, which is positioned between the ends (12, 20) of the first edge 14, to a terminating point that is along first short edge 20. Note that the leading chamfer 18 and the taper 22 along the first parallel edge 19 may intersect at a point on the top face 13 and near the first short edge 20.

Still, referring to FIG. 2, the first edge 14, first short edge 20, and parallel edge 19 also cooperate to form a first wing-like structure 44 that may serve as a handle when the bomberang is thrown. Either wing may serve as the noted handle in that the direction of rotation will remain the same presuming the device is oriented the same for either method (see FIG. 5).

Figure 5:
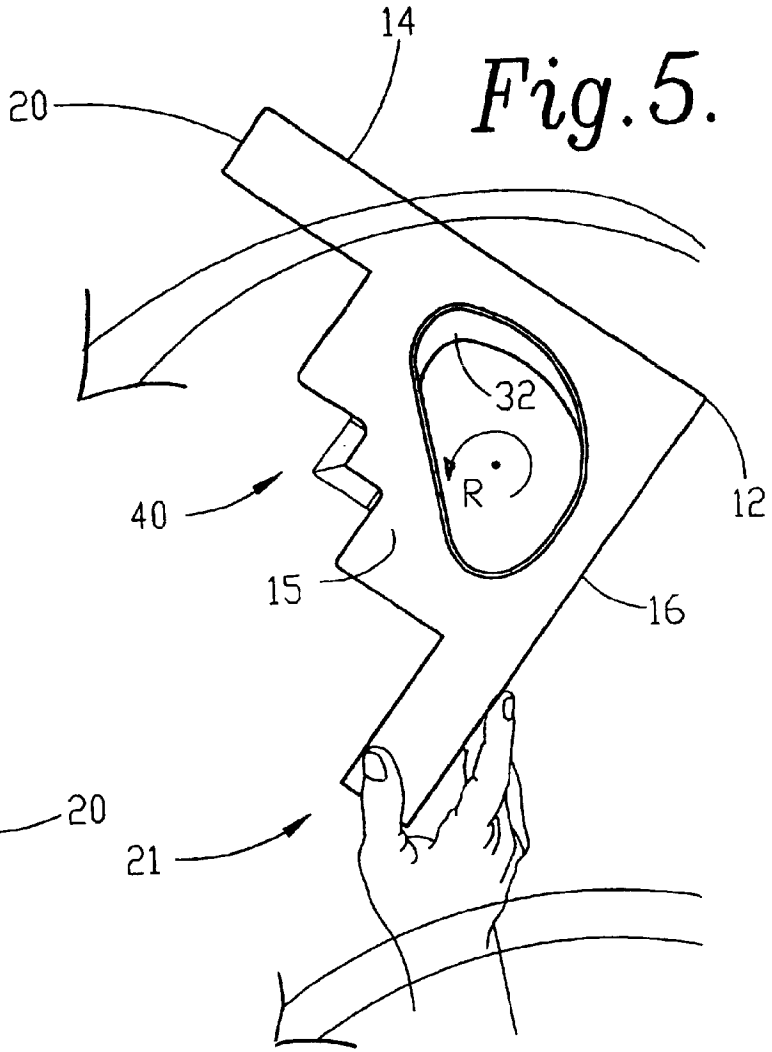
FIG. 5 is a diagram showing a preferred use of the projectile plaything.

The second edge 16 bears a long taper 17 that begins at the nose 12 and broadens linearly along the second edge 16 until it reaches its terminus at the second short edge 21. Note that the second edge 16, the second short edge 21, and the second parallel edge 23 cooperate to form a second wing-like structure 46 that also may serve as an alternate handle when the bomberang is thrown (as shown in FIG. 5).

As shown in FIG. 2, the Bomberang 10 is constructed so that its center of mass, and its angle of rotation, is likely located within the cut-out portion 30 of the bomberang 10. Preferably, the bomberang should be thrown so that it rotates in the direction R about its centroid, so that the enlarged portion of each structure initially slices the air, and the tapered portion(s) follow. For example, an enlarged portion of first edge 14 first engages the air as the bomberang is thrown and as the bomberang 10 rotates, the tapered, thinner, taper 22 of the first parallel edge 19 follows.

Still referring to FIG. 2, as the bomberang 10 continues to rotate in direction R (in FIG. 2, a general clockwise rotation), the second generally-parallel edge 23 will contact still air before the trailing chamfer 17 of second edge 16, so that the enlarged end of this wing-like structure first contacts the air, and the tapered end 17 follows.

Also, as shown in FIG. 2, the cut-out portion 30 also bears a tapered edge 32. The tapered edge 32 should be formed so that, as the bomberang 10 rotates in direction R, an enlarged end first contacts air, and is followed by a thinner, tapered end. This cutout area serves as a continuation of the taper of the wing-like structure 44.

FIG. 2 also gives a detailed view of the third side 40, which bears a general sawtooth like configuration. Three V-Shaped projections 24, 26, 28 are symmetrically positioned between first short edge 20 and second short edge 21. Each of these projections 24, 26, and 28 has respective vertex that points away from, and opposite to, nose 12. The overall effect of the orientation of the nose 12 and the projections 24, 26, 28 is to uniquely imitate the shape of the B2 Bomber. The first projection 24 and the third projection 28 are configured so that, as the bomberang 10 rotates in direction R, an enlared end of the first projection 24 and third projection 28 contact still air before the trailing portion of the respective projection 24, 28. Both edges of V-shaped projection 26, however, are neutrally formed.

With specific reference to FIG. 2, as the bomberang 10 rotates in direction R, the first edge 14 will contact still air; next, the leading edge 34 of first projection 24 will contact the still air; next, the leading edge 36 of the middle projection 26 will contact the still air; next, the leading edge 38 of the final V-Shaped projection 28 will contact still air; and finally, the second parallel edge 23 will slice the still air.

Figure 3:
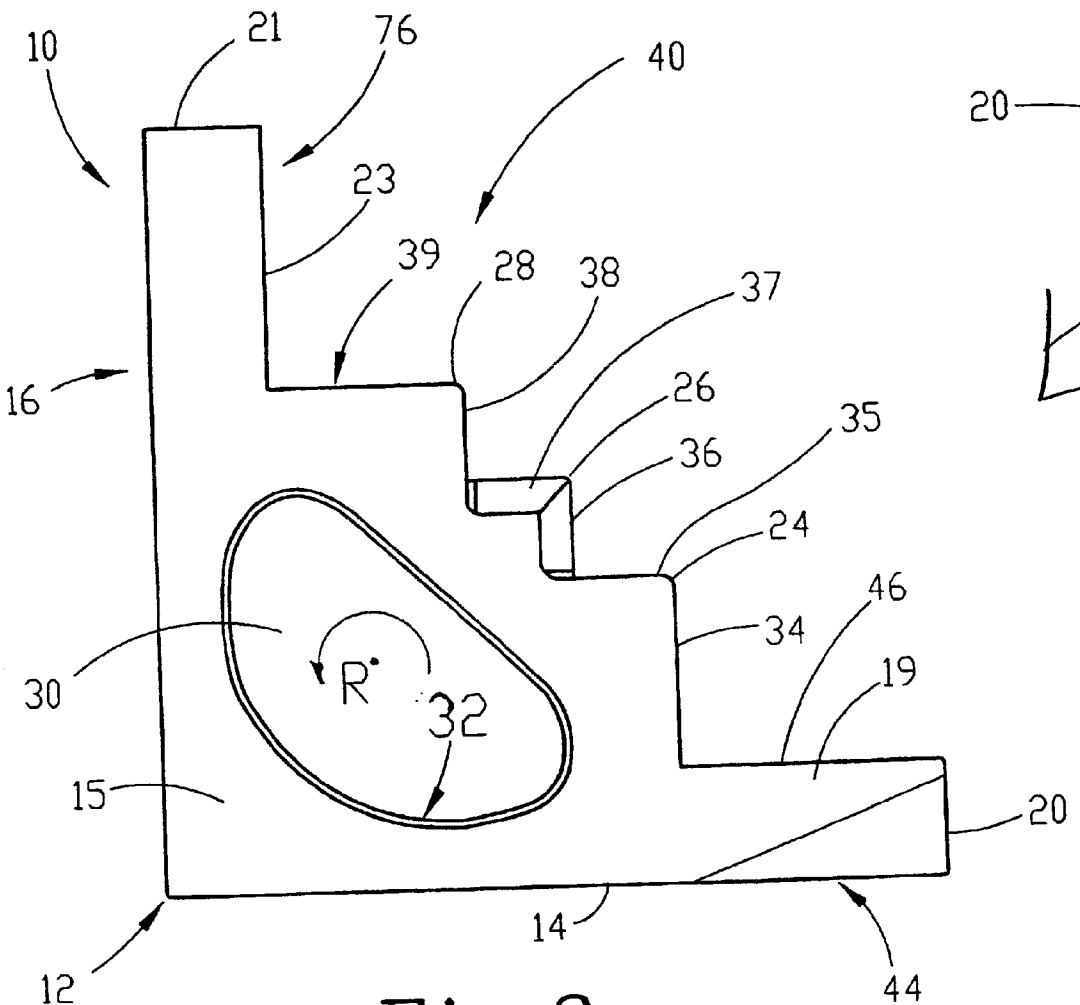
FIG. 3 is an underside view of the projectile plaything.

FIG. 3 shows a bottom view of the bomberang 10. The bomberang has a generally-planar bottom face 15. The fist edge 14 and the second edge 16 meet at the nose point 12, which approximates a right angle. The third edge 40 includes a general sawtooth pattern having three V-Shaped projections 24, 26, 28 that point away from the nose 12.

Still referring to FIG. 3, it is apparent that the V-Shaped projections 24 and 28 bear tapers that terminate with the bottom face 15; thus, the tapers on these projections 24, 28 are not viewable from the bottom view. However, note that the middle V-Shaped projection 26 has tapers that are visible from the bottom view. In this preferred embodiment shown in FIG. 3, the middle V-Shaped projection 26 contains "neutral" tapes on both its trailing edge 37 and the leading edge 36.

As seen in FIG. 3, the direction of rotation R is counter-clockwise with respect to bottom face 15. The first edge 14 is the first to contact still air when the bomberang 10 rotates in direction R, and first edge 14 is then followed by the leading edge 34 of the first V-Shaped projection 24. The next leading edge to cut the still air will be the leading edge 36 of the middle V-Shaped protrusion 26; after that, the next leading edge to cut still air would be the leading edge 38 of the third V-Shaped protrusion 28, and finally, the second short parallel edge 23 will cut the air. The trailing edges—namely, first parallel edge 19, trailing edge 35, trailing edge 37, trailing edge 39, and second edge 16—should all be tapered to provide airfoil effect.

As seen in FIG. 3, the first edge 14 and the first short edge 20 and the first parallel edge 19 cooperate to form a winglike structure 44 that can be used as a handle to throw the bomberang 10. Analogously, the second edge 16, the second short edge 21, and the second parallel edge 23 cooperate to form a winglike structure 46 that can be used as an alternate handle to throw the bomberang 10.

Figure 4:
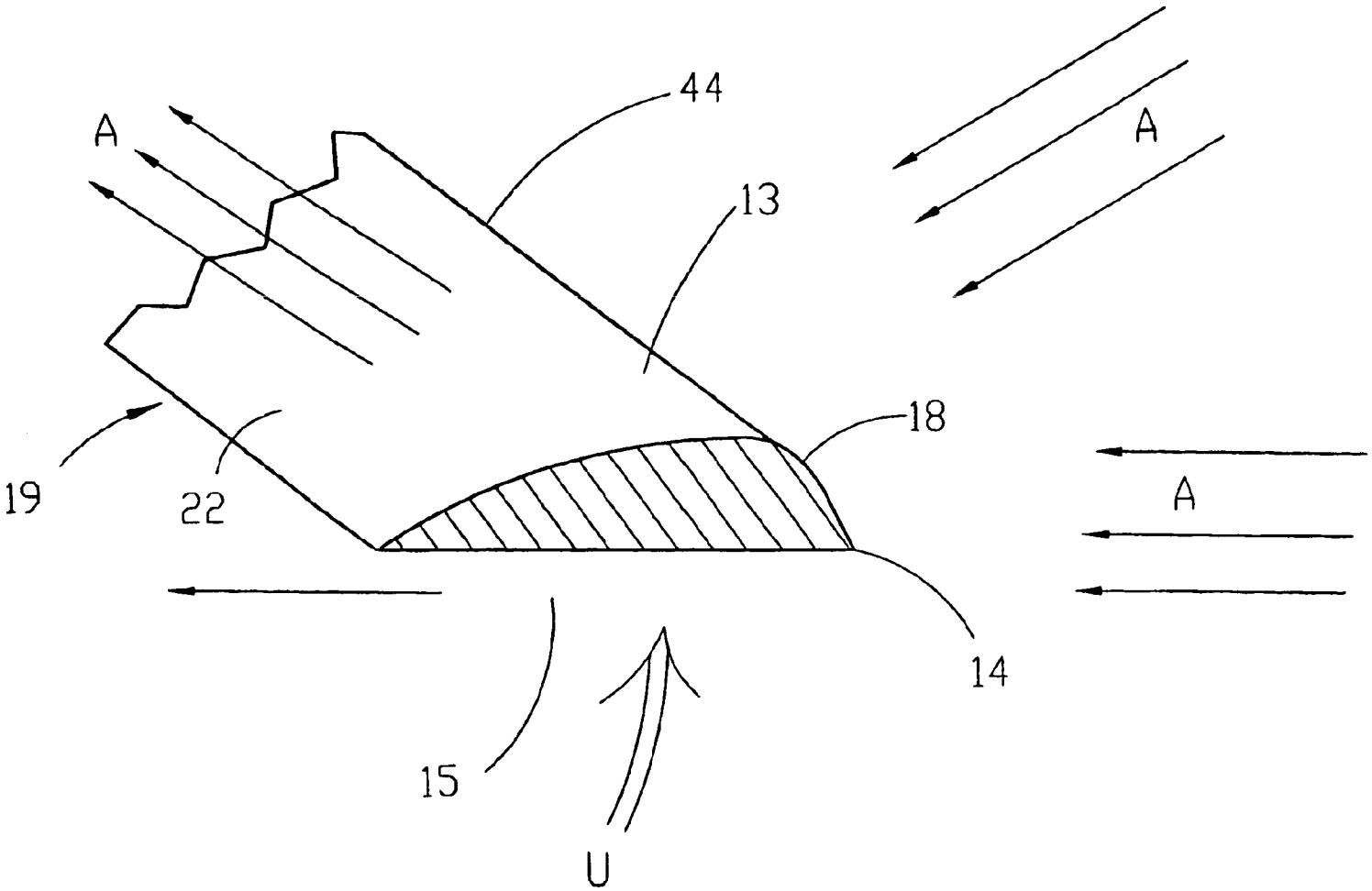
FIG. 4 shows a cross-sectional view, at plane IV shown in FIG. 1.

FIG. 4 shows a perspective view of a cross-section of the wing-like structure 44, taken at a plane as shown in FIG. 1. FIG. 4 shows shape of the first edge 14, which has a leading chamfer 18 on a bulbous edge that faces directly into the airflow A. The first edge 14 first contacts the airflow A, then the taper 22 of the first parallel edge 19 passes through the same airflow A. As the enlarged portion of the first edge 14 pushes through airflow A, causing a change of linear fluid momentum. This change in linear fluid momentum creates a lower pressure center on the top face 13 of the wing, and therefore a resulting force that propels the bomberang in the direction U. An equal and opposite propulsion occurs at the opposite winglike structure 46 (as seen in FIG. 1-3), which in turn causes to propel the bomberang 10 in a large arcuate path resulting in a flight termination location within the same general area as its origination.

FIG. 5 shows the bomberang 10 as it would be thrown, shown with a view toward the bottom face 15 so that the direction of rotation R is counter-clockwise. The nose 12 rotates downwardly after this release, and then first edge 14 cuts through the still air, followed by the third edge 40 (bearing sawtooth pattern), and the rotation is completed as second edge 16 follows closely behind.

Having described the invention in detail, the descriptions hereinabove should be considered for illustration only and not for limitation purposes. The scope of the invention shall be limited only by the appended claims.

Having described and illustrated the invention in detail, it is to be understood that the above and foregoing is for illustration and demonstration only. The descriptions herein are not intended to limit the breadth of this invention. The breadth of this invention is limited only by the appended claims.

I claim:

1. A projectile plaything, comprising:

a top face and an opposite facing bottom face;

a nose point formed at respective initial points of a first edge and a second edge, the first and second edges bearing generally equal lengths;

a third edge having a generally jagged sawtooth pattern, the third edge extending between terminal points of the first and second edges, the jagged sawtooth pattern having a first short edge extending from the terminal point of the first edge in a direction generally parallel to the second edge, and a first parallel edge extending from the first short edge and running generally parallel to the first edge; and, a second short edge extending from a terminal point of the second edge in a direction generally parallel to the first edge, and a second parallel edge extending from the second short edge and running generally parallel to the second edge, the respective first and second parallel edges each bearing a taper terminating adjacent the respective parallel edge; and, at least one V-Shaped projection, each V-Shape having a vertex that points away from the nose point;

a leading chamfer formed along the first edge and angling from the top face toward the bottom face, the leading chamfer having a starting point positioned along the first edge and linearly broadening distal the starting point of the leading chamfer;

a trailing taper formed along the second edge and starting from the nose point and linearly broadening distal the vertex;

a cut-out portion extending throughout the top face and the bottom face and positioned between the nose point and the saw-tooth pattern, wherein edges of the cut-out portion bear a chamfer generally parallel to the trailing taper.

2. The projectile plaything as in claim 1, wherein the trailing taper starts from the nose point and terminates adjacent the second short edge.

3. The projectile plaything as in claim 1, wherein the leading chamfer starts at a point on the first edge that is generally equidistant.

4. The projectile plaything as in claim 1, the sawtooth pattern consisting of a first, a middle, and a third V-Shaped projection; and wherein, an outline of the plaything is generally symmetric about a line passing through the nose and a vertex of the middle V-Shaped projection.

5. The projectile plaything as in claim 4, wherein the first, middle, and third V-Shaped projections each bear a leading edge that is generally parallel to the second edge of the plaything, and a trailing edge that is generally parallel to the first edge of the plaything; and, the trailing edge of each of the first and third V-Shaped projection bears a taper.

6. A projectile plaything, comprising:

a generally planar structure having a nose formed at a vertex of a first edge and a second edge;

a third edge connecting terminal points of the first and second edges, the third edge bearing a first, second and third V-Shaped projection, each V-Shaped projection having a point that points in a direction generally opposite the nose;

a cut-out portion extending throughout a top face and a bottom face of the plaything and formed between the nose and the third edge;

wherein, as the plaything is thrown so that it rotates about a center of mass so that each V-Shaped projection has a leading edge V-Shape that contacts air initially when rotated, and a trailing edge of the V-Shape that follows the leading edge when rotated, each of the second edge of the plaything; and the trailing edge of the first V-Shaped projection; and, the trailing edge of the third V-Shaped projection are each tapered with respect to the first edge of the plaything; and the leading edge of the first V-Shaped projection, and the leading edge of the third V-Shaped projection, respectively;

thereby creating an airfoil effect that propels the plaything to fly in an arcuate path that terminates in an area adjacent to a point of origin of the arcuate path.

7. The projectile plaything as in claim 6, further comprising:

a chamfer formed on an edge of the cut-out portion, the chamfer being generally parallel to the taper formed on the second edge.

8. The projectile plaything as in claim 6, wherein each taper originates from the top face and terminates adjacent the bottom face.

9. The projectile plaything as in claim 6, wherein the second V-Shaped projection is positioned between the first and third V-Shaped projections; and, the second V-Shaped projection bears a neutral cut on both of its leading edge and trailing edge.

10. The projectile plaything as in claim 6, wherein the projectile plaything is made of one of plastic or wood.

11. The projectile plaything as in claim 6, wherein, the taper formed along the second edge originates at the nose, and linearly broadens along the second edge.

12. The projectile plaything as in claim 6, further comprising:

a first short edge formed at a terminal point of the first edge, the first short edge extending generally parallel to the second edge; and, a first parallel edge extending between the first short edge and an endpoint of the leading edge of the first V-Shaped projection; wherein, the first parallel edge is tapered with respect to the first edge.

13. The projectile plaything as in claim 12, wherein, the first short edge, the first parallel edge, and the first edge cooperate to form a first handle enabling one to rotatably throw the plaything so that it rotates about its center of mass in flight.

14. The projectile plaything as in claim 6, further comprising:

a second short edge formed at a terminal point of the second edge and extending generally parallel to the first edge; and, a second parallel edge extending between the second edge to and endpoint of the leading edge of the third V-Shaped projection; wherein, the second parallel edge is enlarged with respect to the second edge.

15. The projectile plaything as in claim 14, wherein the second short edge, the second parallel edge, and the second edge cooperate to form a second handle enabling one to rotatably throw the plaything so that it rotates about its center of mass in flight.

* * * * *